US006601937B2

(12) United States Patent
Hotomi et al.

(10) Patent No.: US 6,601,937 B2
(45) **Date of Patent: *Aug. 5, 2003**

(54) IMAGE FORMATION APPARATUS THAT CAN FORM AN IMAGE EFFICIENTLY

(75) Inventors: Hideo Hotomi, Nishinomiya (JP); Shoichi Minato, Sakai (JP)

(73) Assignee: Minolta Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/022,855

(22) Filed: Feb. 12, 1998

(65) Prior Publication Data

US 2003/0095159 A1 May 22, 2003

(30) Foreign Application Priority Data

Feb. 14, 1997 (JP) ..... 9-030623

(51) Int. Cl.[7] ..... B41J 2/205; B41J 2/15
(52) U.S. Cl. ..... 347/15; 347/40
(58) Field of Search ..... 347/43, 15, 40

(56) References Cited

U.S. PATENT DOCUMENTS

| | | | | |
|---|---|---|---|---|
| 4,503,444 A | | 3/1985 | Tacklind | |
| 5,745,131 A | * | 4/1998 | Kneezel et al. | 347/15 |
| 5,870,503 A | * | 2/1999 | Kumashiro | 382/252 |

FOREIGN PATENT DOCUMENTS

| | | | | |
|---|---|---|---|---|
| JP | 35801764 | * | 1/1983 | B41J/3/04 |
| JP | 401242259 | * | 9/1989 | B41J/3/04 |

* cited by examiner

*Primary Examiner*—Thinh Nguyen
*Assistant Examiner*—Alfred Dudding
(74) *Attorney, Agent, or Firm*—Sidley Austin Brown & Wood LLP

(57) ABSTRACT

An image formation apparatus is provided that carries out printing efficiently to improve the printout speed. In the ink jet printer, a straight line formed of dots ejected from a large diameter nozzle and a straight line formed of dots ejected from a small diameter nozzle can have a similar configuration. By the continuous output of two dots from the small diameter nozzle, a combination of these dots are substantially equal to dots ejected from the large diameter nozzle.

28 Claims, 12 Drawing Sheets

3

IMAGE FORMATION APPARATUS THAT CAN FORM AN IMAGE EFFICIENTLY

BACKGROUND OF THE INVENTION

1. Field of the Invention

The present invention relates to image formation apparatuses, and more particularly, to an image formation apparatus having a printout portion of a plurality of formats.

2. Description of the Related Art

This application is based on Japanese Patent Application No. 9-030623 filed in Japan, the contents of which are hereby incorporated by reference.

Conventional ink jet printers have a piezoelectric element employed in the printer head. In this printer head, the ink in a predetermined closed cavity is pressurized by the deflection of a piezoelectric element driven by application of a voltage. The ink subjected to pressure is ejected towards a recording sheet in the form of an ink droplet through a nozzle hole provided in the predetermined closed cavity.

Some of these printer heads have nozzle holes of two different diameters. Ink droplets of a plurality of sizes can be ejected to realize representation of a half tone image smoothly and efficiently by the provision of nozzle holes with different diameters and by varying the level of the voltage for driving the piezoelectric element.

When an image absent of the half tone level is to be represented, for example when only characters are to be printed out on a recording sheet by the above-described printer head, the nozzle with the smaller diameter will not be used. Printing is carried out only through the nozzle having the greater diameter. This means that the efficiency is poor.

SUMMARY OF THE INVENTION

In view of the foregoing, an object of the present invention is to provide an image formation apparatus that can carry out printing efficiently to increase the printout speed.

According to an aspect of the present invention, an image formation apparatus includes a first printout portion for printing out a dot of a predetermined size, a second printout portion for printing out a dot of a size smaller than the predetermined size, and a controller for providing control so that a dot of a size substantially equal to the size of a dot formed by the first printout portion is printed out using the second printout portion.

According to another aspect of the present invention, a printout control method is characterized in that a dot of a size substantially equal to the size of a dot formed by the first printout portion is printed out using the second printout portion.

According to a further aspect of the present invention, a control device of an image formation apparatus is characterized by including a controller for providing control so as to carry out printing by said first printout portion as well as printing out a dot of size substantially equal to the size of a dot formed by the first printout portion using the second printout portion.

According to the present invention, an image formation apparatus can be provided that carries out printing efficiently to improve the printout speed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An ink jet printer according to an embodiment of the present invention will be described hereinafter with reference to the drawings.

Figure 1:
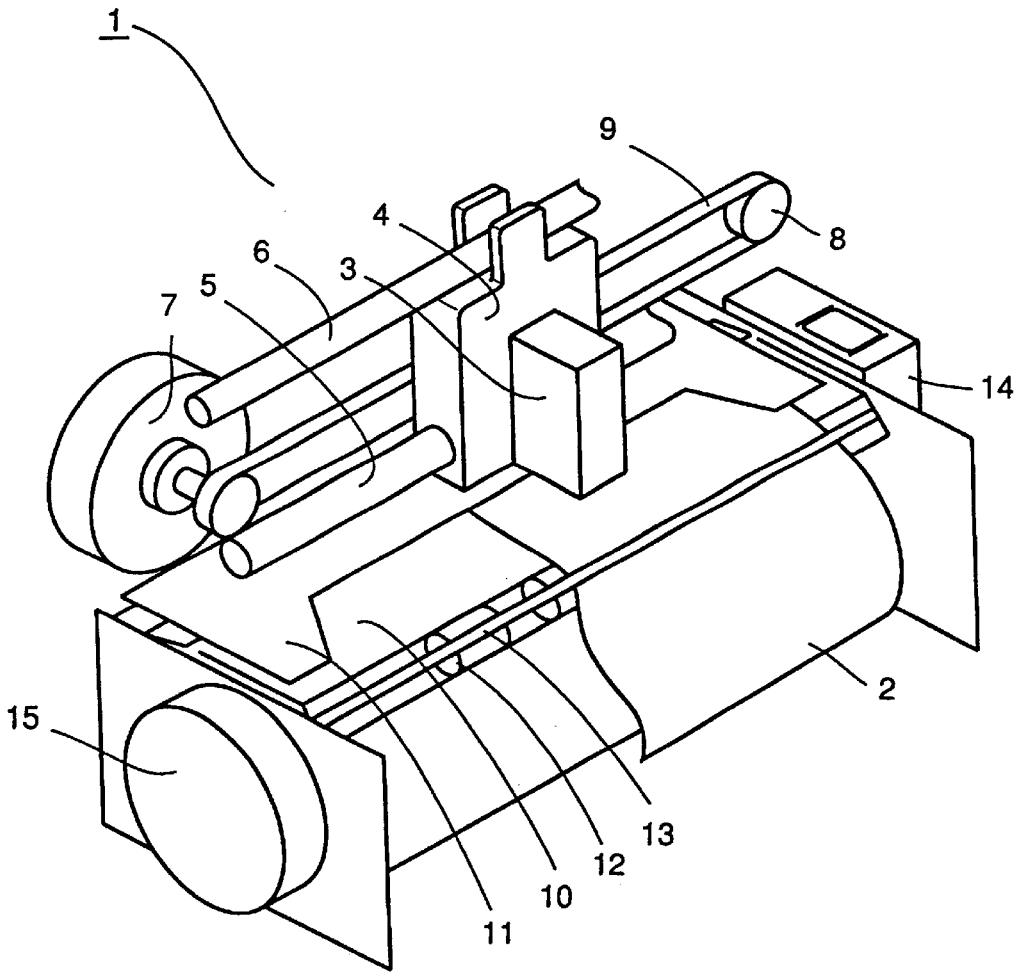
FIG. 1 is a perspective view of a schematic structure of an ink jet printer 1 according to a first embodiment of the present invention.

Referring to FIG. 1, an ink jet printer 1 according to a first embodiment of the present invention includes a recording sheet 2 which is a recording medium such as a paper sheet or an OHP sheet, a printer head 3 which is an ink jet type printer head, a carriage 4 for holding printer head 3, slide shafts 5 and 6 on which carriage 4 is moved back and forth in parallel to the recording surface of recording sheet 2, a drive motor 7 for driving carriage 4 back and forth along slide shafts 5 and 6, a timing belt 9 for converting the rotation of drive motor 7 into a reciprocating motion of carriage 4, and an idle pulley 8.

Ink jet printer 1 also includes a platen 10 serving as a guide plate for guiding recording sheet 2 along a transportation path, a sheet press plate 11 for sandwiching recording sheet 2 with platen 10 to prevent undulation of recording sheet 2, a discharge roller 12 and a spur roller 13 for discharging recording sheet 2, a recovery system 14 for restoring the ink eject error of printer head 3 to a favorable state, and a sheet feed knob 15 for moving recording sheet 2 manually.

Recording sheet 2 is transferred to a recording unit facing printer head 3 and platen 10 manually or by a sheet feed device such as a cut sheet feeder. At this stage, the amount of rotation of the sheet feed roller (not shown) is controlled to provide control of the transportation to the recording unit.

A piezoelectric element (PZT) is employed as the energy generation source to eject ink in printer head 3. A voltage is applied to the piezoelectric element to generate a strain. This strain alters the volume of the channel filled with ink. This change in the volume causes ink to be ejected from a nozzle provided in the channel, whereby recording onto recording sheet 2 is effected.

Carriage 4 implements main scanning in the direction along slide shafts 5 and 6 (the direction transversing recording sheet 2) by drive motor 7, idle pulley 8, and timing belt 9, whereby printer head 3 attached to carriage 4 records an image of one line. Recording sheet 2 is forwarded for subscanning in the direction perpendicular to the main scanning direction every time one line is recorded. Then the next line is recorded.

An image is thus recorded onto recording sheet 2. Recording sheet 2 passing through the recording unit is discharged by discharge roller 12 located downstream in the transportation path and spur roller 13 attached thereto with pressure.

Figure 2:
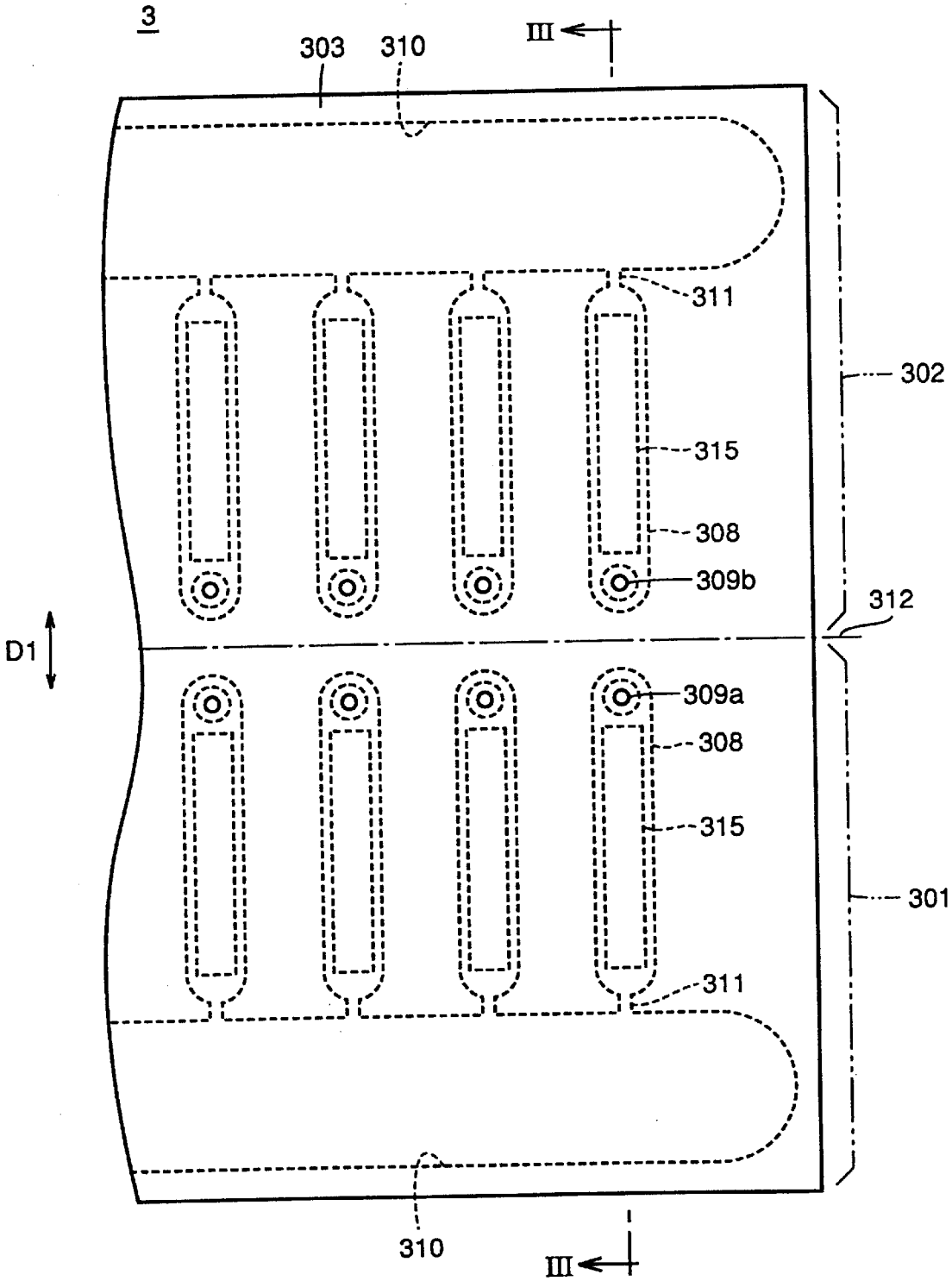
FIG. 2 is a plan view of a printer head 3 for describing the structure thereof.
Figure 3:
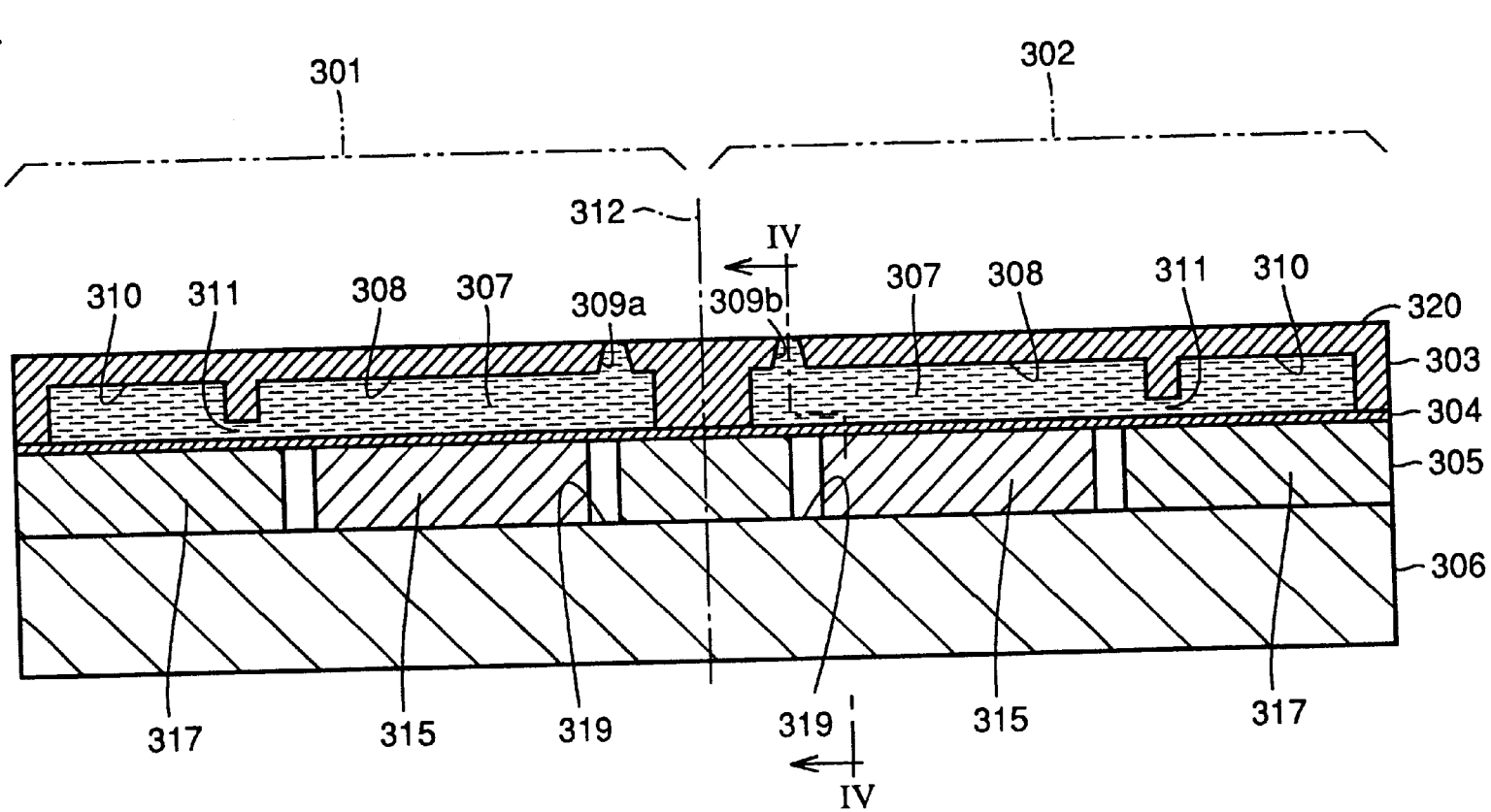
FIG. 3 is a sectional view of printer head 3 taken along sectional line III—III of FIG. 2.
Figure 4:
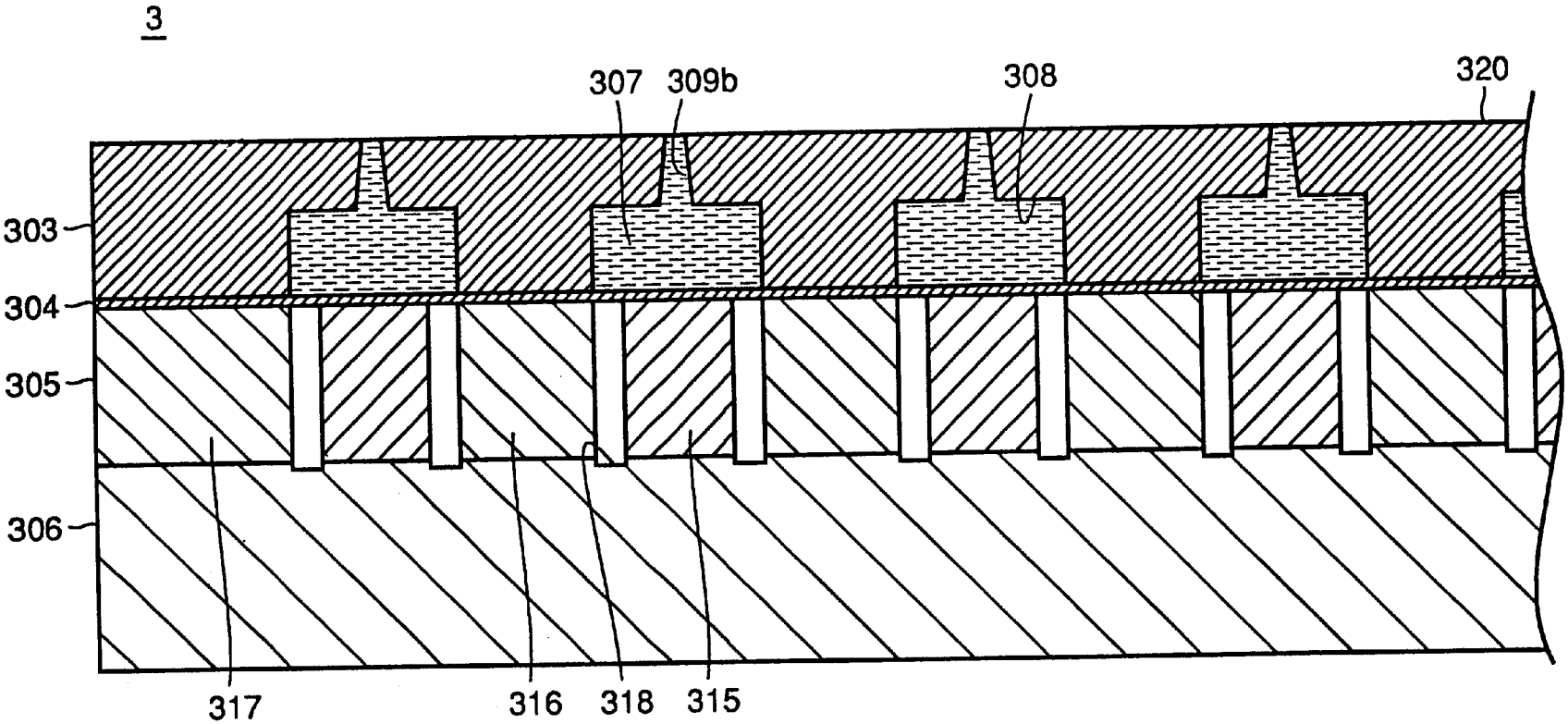
FIG. 4 is a cross sectional view of printer head 3 taken along sectional line IV—IV of FIG. 3.

FIGS. 2, 3 and 4 are diagrams for describing the structure of printer head 3.

Printer head 3 includes a large diameter head portion 301 and a small diameter head portion 302. The main scanning direction of printer head 3 is indicated by an arrow D1. Large diameter head portion 301 and small diameter head portion 302 have a structure in which a nozzle plate 303, a partition wall 304, a diaphragm 305, and a substrate 306 are overlaid integrally. Regarding ink droplets of a plurality of dot diameters, an ink droplet of a large dot diameter is ejected from a large diameter nozzle 309*a* of large diameter head unit 301. An ink droplet of a small dot diameter is ejected from a small diameter nozzle 309*b* of small diameter head portion 302.

Nozzle plate 303 is formed of metal or ceramic. A water repellent coat layer is provided on a surface 320. The plane of nozzle plate 303 facing partition wall 304 is fine-worked using Ni electro-forming or a photoresist. A plurality of ink channels 308 for storing ink 307 and an ink inlet 311 for connecting each ink channel 308 with an ink supply chamber 310 are provided in large diameter head portion 301 and small diameter head portion 302.

As shown in FIG. 3, ink channel 308 of large diameter head portion 301 and small diameter head portion 302 is formed in a longitudinal groove configuration and in parallel extending along a direction where large diameter head portion 301 and small diameter head portion 302 face each other. Ink supply chamber 310 and ink channel 308 are formed symmetrically about a center line 312, and connected to an ink tank not shown.

Wall partition 304 is formed of a thin film. Partition wall 304 is fixed between nozzle plate 303 and diaphragm 305. Partition wall 304 is fixed in a state where a predetermined tension is applied.

Diaphragm 305 includes a PZT 315 which is a piezoelectric element deformed in configuration in response to application of a voltage. Diaphragm 305 is provided by being fixed to a substrate 306 with an insulation adhesive, and then divided with separate grooves 318 and 319 by dicer working. By this division, isolation is provided among PZT 315 corresponding to each ink channel 308, a PZT column 316 located between adjacent PZTs 315, and a wall 317 enclosing the same. As PZT 315, a stacked layer type PZT body is used formed by stacking 21 PZT layers, each layer 35 $\mu$m in thickness, and then applying a sintering process thereto.

In printer head 3 of the above-described structure, ink 307 is supplied to ink supply chamber 310 from an ink tank not shown connected to an ink cartridge. Ink 307 of ink supply chamber 310 is provided to each ink channel 308 through ink inlet 311.

A predetermined voltage corresponding to a printout signal is applied across a common electrode and an individual electrode provided at both ends of PZT 315 from a head driver 56 that will be described afterwards. PZT 315 is deformed in a direction urging partition wall 304. Deformation of PZT 315 is transmitted to partition wall 304, whereby pressure is applied to ink 307 in ink channel 308. As a result, an ink droplet is ejected towards recording sheet 2 from large diameter nozzle 309*a* and small diameter nozzle 309*b*.

Figure 5:
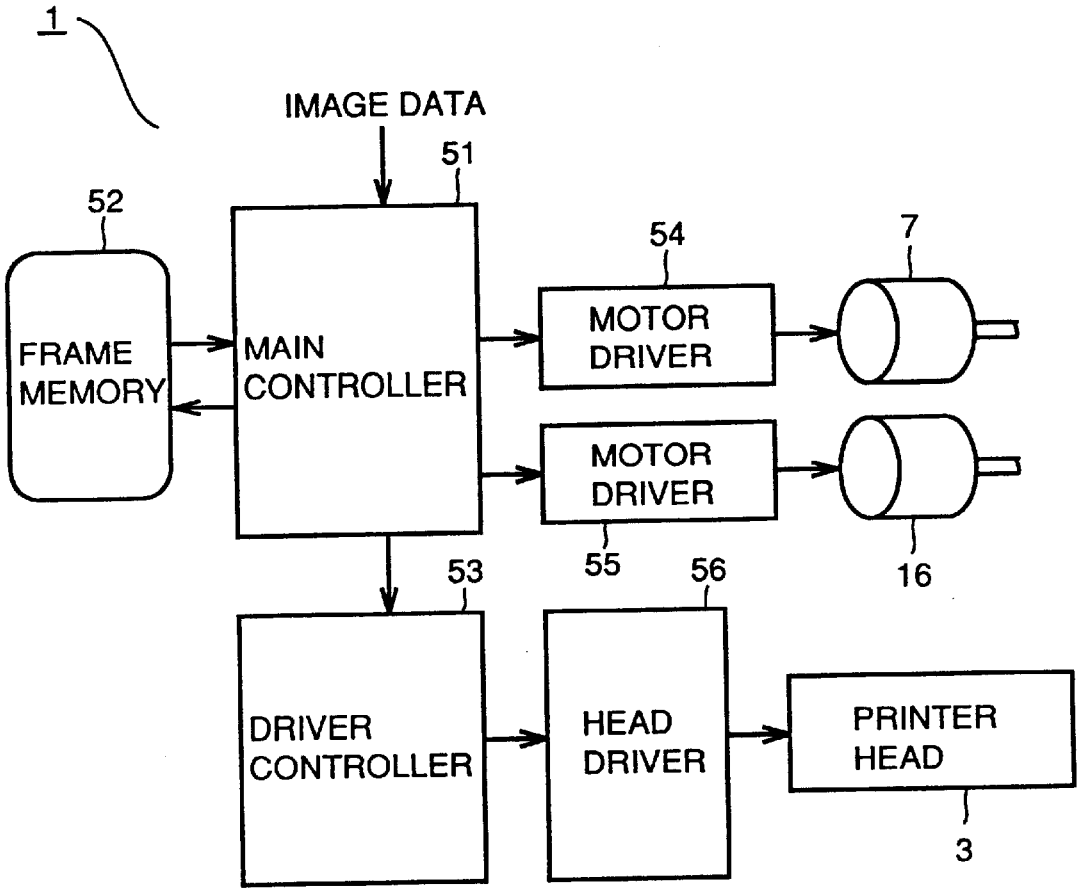
FIG. 5 is a block diagram for describing a control unit of ink jet printer 1.

FIG. 5 is a block diagram for describing a control unit of ink jet printer 1.

A main controller 51 receives image data from a computer and the like. The image data is stored in a frame memory 52 for buffer for every one frame. In the printout onto recording sheet 2, main controller 51 controls the drive of drive motor 7 of carriage 4 and the sheet feed motor 16 via motor drivers 54 and 55.

In addition to this driver control, main controller 51 provides control of the drive of PZT 315 in large and small diameter head portions 301 and 302 of printer head 3 via driver controller 53 and head driver 56 on the basis of the image data read out from frame memory 52.

By controlling the driving voltage applied to PZT 315 by head driver 56, the printout operation is achieved.

FIGS. 6–9B are diagrams for describing a printout by ink jet printer 1.

Figure 6:
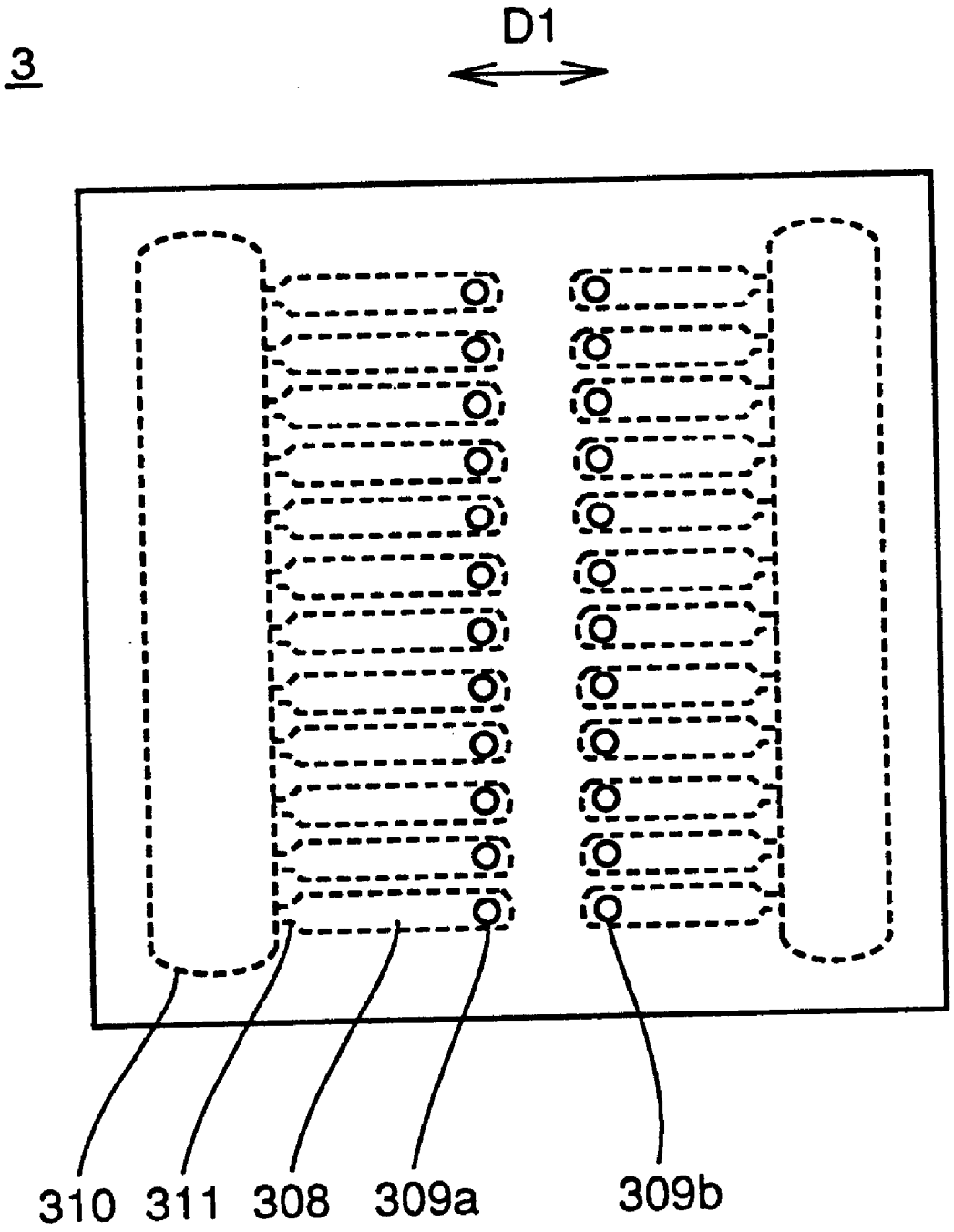
FIG. 6 is a diagram for describing the arrangement of a large diameter nozzle 309*a* and a small diameter nozzle 309*b* of printer head 3.

FIG. 6 is a plan view of printer head 3 of FIG. 2. Reference characters in FIG. 6 correspond to those of FIGS. 2–4.

Here, the diameter of large diameter nozzle 309*a* is 33 $\mu$m, and the diameter of small diameter nozzle 309*b* is 24 $\mu$m. Referring to FIG. 6, printer head 3 has 12 nozzle holes in each of the row of large diameter nozzles 309*a* and small diameter nozzles 309*b*. It is assumed that the middle ten nozzle holes are used in the printout.

Figure 7:
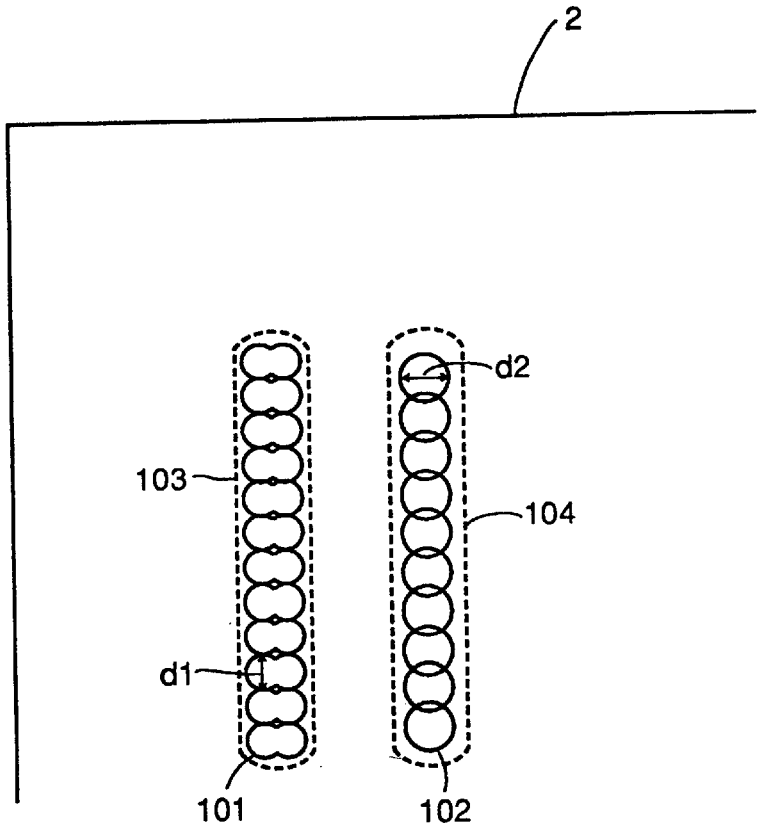
FIG. 7 shows dots printed out on a recording sheet 2 from large diameter nozzle 309*a* and small diameter nozzle 309*b* of printer head 3 of FIG. 6.
Figure 8:
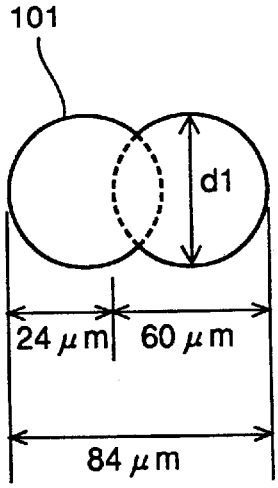
FIG. 8 shows in detail a dot output from small diameter nozzle 309*b* of FIG. 7.

Dots recorded on recording sheet 2 from large diameter nozzle 309*a* and small diameter nozzle 309*b* of printer head 3 of FIG. 6 are shown in FIG. 7. FIG. 8 shows the detail of a dot 101 output from small diameter nozzle 309*b* of FIG. 7.

Figure 9A:
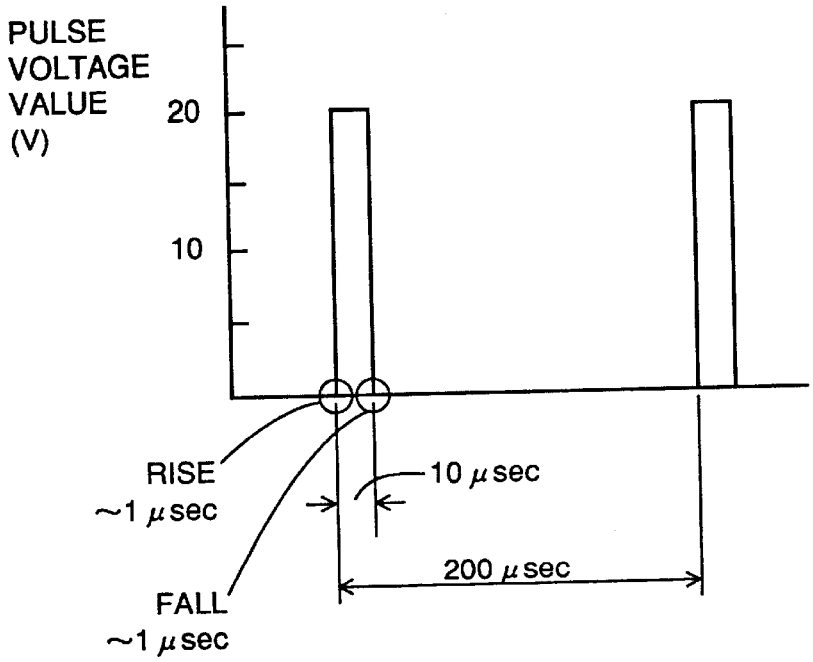
FIGS. 9A and 9B are diagrams showing the driving voltage to be applied to a PZT 315 to print out the dot shown in FIG. 7.
Figure 9B:
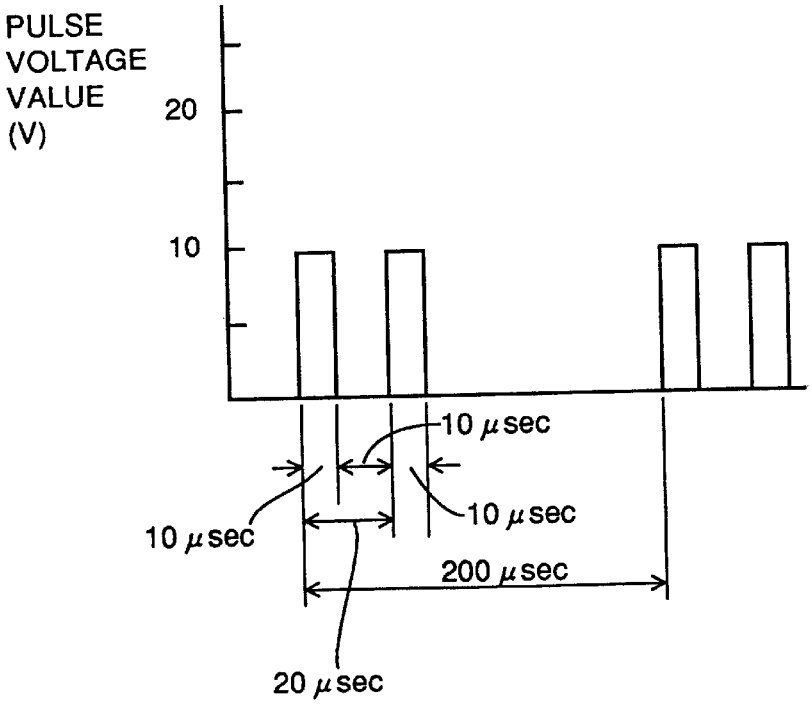

FIG. 9A shows the driving voltage applied to PZT 315 to allow an ink droplet to be ejected from large diameter nozzle 309*a*. FIG. 9B shows the driving voltage applied to PZT 315 to allow an ink droplet to be ejected from small diameter nozzle 309*b*. Although a rectangular waveform is shown, the wave may be in the form of a trapezoidal waveform, a sawtooth waveform and the like, as necessary.

A driving voltage having a rising edge and a falling edge of 1 $\mu$sec. each, an amplitude of 20 V with a duration of 10 $\mu$sec. is applied to PZT 315 corresponding to large diameter nozzle 309*a*. This driving voltage corresponds to one dot 102.

By applying this driving voltage to each PZT 315 corresponding to the ten large diameter nozzles 309*a*, a dot 102 having a diameter d2 (refer to FIG. 7) of approximately 84 $\mu$m is printed out from large diameter nozzle 309*a*.

A driving voltage having a rising edge and a falling edge of 1 $\mu$sec and an amplitude of 10 V with a duration of 10 $\mu$sec is applied to PZT 315 corresponding to small diameter nozzle 309*b*. This driving voltage corresponds to one dot 101. After 10 $\mu$sec., a similar voltage is continuously applied.

By applying this driving voltage to each PZT 315 corresponding to the ten small diameter nozzles 309*b*, a dot 101 having a diameter d1 (refer to FIGS. 7 and 8) of approximately 60 μm is output continuously from small diameter nozzle 309*b*. By appropriately setting the speed and the printout cycle of carriage 4 (refer to FIG. 1) holding printer head 3 so that the distance between the center of the dot diameters printed on a recording sheet (recording sheet 2 in FIG. 1) becomes approximately 24 μm, a printout similar to that printed out by dot 102 from large diameter nozzle 309*a* can be obtained (FIG. 8). More specifically, a straight line 104 which is a combination of ten dots 102 output from large diameter nozzle 309*a* and a straight line 103 which is a combination of twenty dots 101 output from small diameter nozzle 309*b* result in a printout of a similar configuration.

By using an ink jet printer that provides printout control as described above, a printing operation can be carried out using nozzles of a large diameter and a small diameter effectively. In binary printing, the usage of two types of nozzles allows printout to be carried out efficiently to improve the printout speed in contrast to the conventional case where only one type of nozzle was used.

An ink jet printer according to a second embodiment of the present invention will be described hereinafter.

Figure 10:
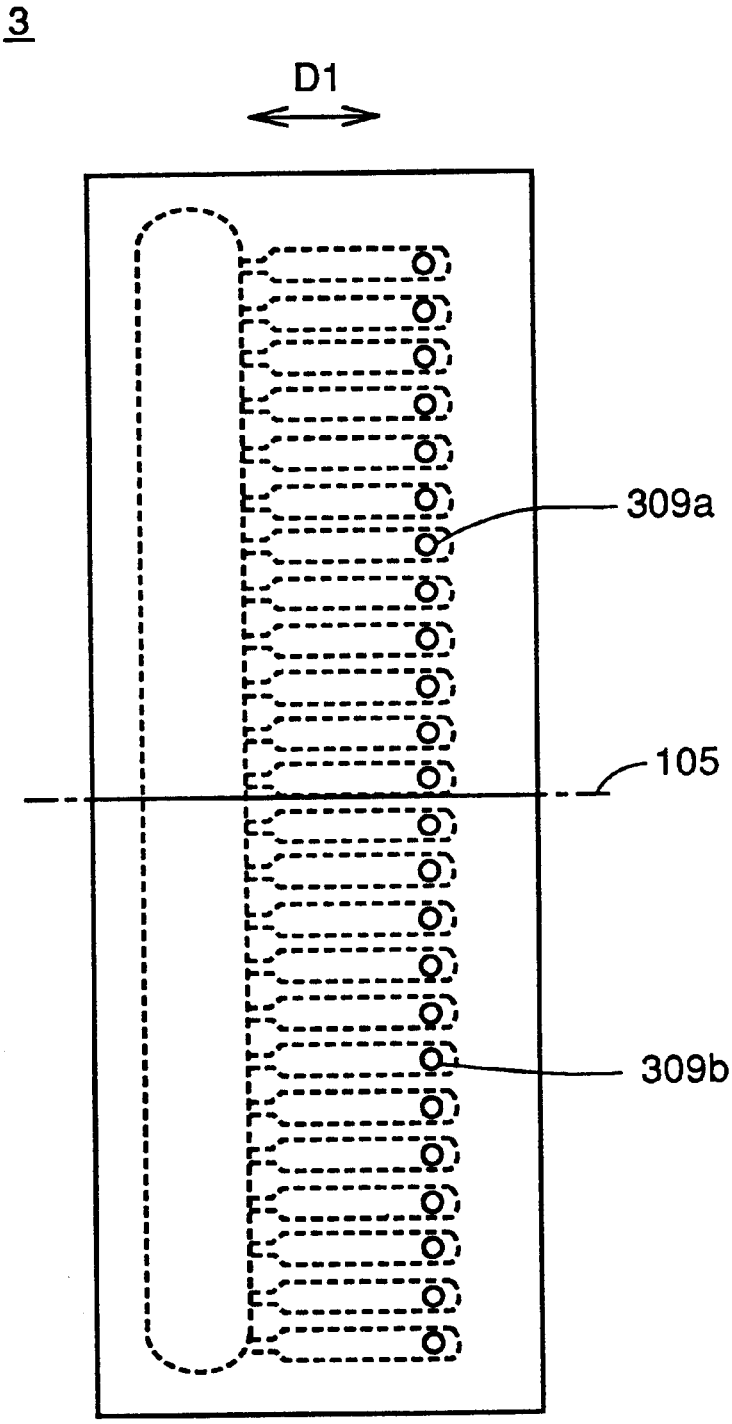
FIG. 10 is a diagram for describing the arrangement of large diameter nozzle 309*a* and small diameter nozzle 309*b* of printer head 3 of an ink jet printer according to a second embodiment of the present invention.
Figure 11:
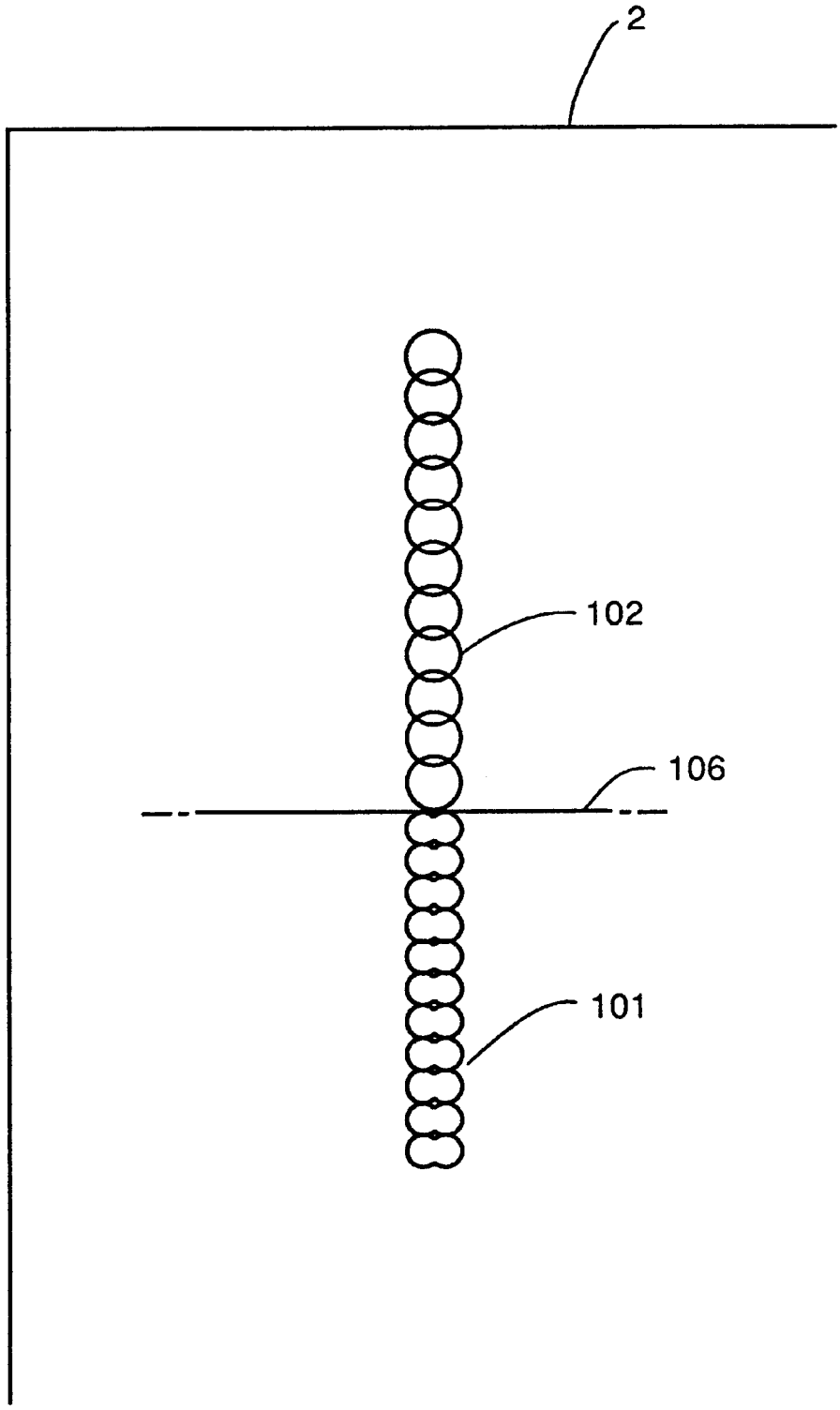
FIG. 11 is a diagram showing a dot printed out from large diameter nozzle 309*a* and small diameter nozzle 309*b* of printer head 3 of FIG. 10.

FIG. 10 is a diagram for describing the arrangement of large diameter nozzle 309*a* and small diameter nozzle 309*b* of printer head 3. FIG. 11 shows dots printed out from large and small diameter nozzles 309*a* and 309*b* of printer head 3 of FIG. 10. FIGS. 10 and 11 correspond to FIGS. 6 and 7, respectively.

Among the total of 24 nozzles of both the large and small diameter nozzles shown in FIG. 10, the twenty nozzles located at the middle portion are used. The structure except for the structure of large and small diameter nozzles is similar to that of ink jet printer 1 of the first embodiment.

The second embodiment differs from the first embodiment in that the printout area is doubled by arranging large diameter nozzles 309*a* and small diameter nozzles 309*b* continuously perpendicular to the direction of arrow D1 which is the main scanning direction with a center line 105 as the boundary.

Similar to the first embodiment, a driving voltage is applied to a PZT in the second embodiment to obtain a printout of the configuration shown in FIG. 11. Here, a center line 106 implies a boarder line between printed out dots from large diameter nozzle 309*a* and printed out dots from small diameter nozzle 309*b*.

By using an ink jet printer that provides control of the above-described printing, it is possible to carry out printing using nozzles of a large diameter and a small diameter effectively, so that the printout area is increased two times. Furthermore, in binary printing, the printing operation can be carried out efficiently to improve the printout speed to almost two times that of a conventional case.

Although the present embodiment is described in which the printout formed of a linear combination of two rows of dots output from a small diameter nozzle and a printout formed of a linear combination of one row of dots output from a large diameter nozzle result in similar printouts, it is possible to have dots of three or more rows of dots from a small diameter nozzle correspond to one or more rows of dots from a large diameter nozzle.

In the present embodiment, the printed out dot has a circular shape. The present invention is also applicable to a dot having another shape such as an ellipse.

Modification

The present invention can also be applied to a color printer. In the field of color printers, the art is known of replacing the gray portion in color with black (K) in printing out color (YMC) dots (UCR; Under Color Removal). By printing out dots of the small diameter two times instead of printing out one black dot with a large diameter, dot printout corresponding to a dot of large diameter can be achieved.

Figure 12A:
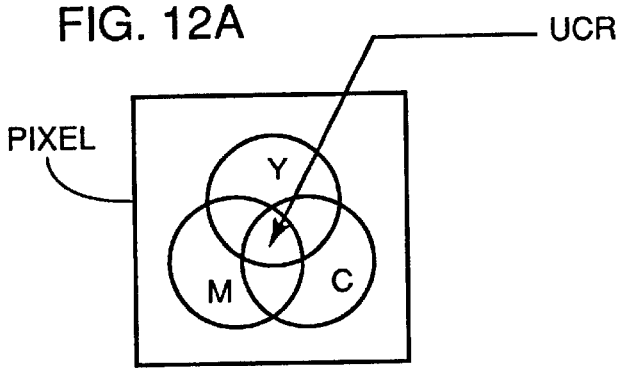
FIGS. 12A–12C are diagrams for describing modifications of the embodiment of the present invention.
Figure 12B:
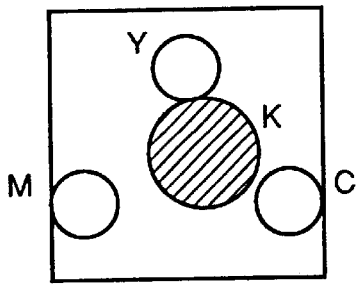
Figure 12C:
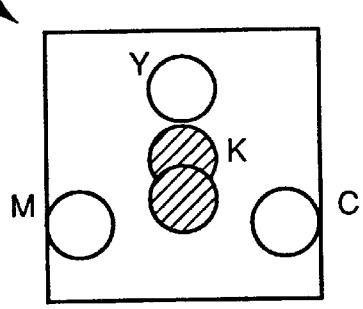

More specifically, referring to FIG. 12A, the portion where yellow (Y), magenta(M), and cyan (C) overlap is substituted with black dots. Here, a black dot of a large diameter can be printed out once as shown in FIG. 12B, or two black dots of a small diameter can be printed out two times in a shifted manner as shown in FIG. 12C, resulting in a printout substantially equal to that of FIG. 12B.

Modifications of a printer head of a color printer that carries out such printing are shown in FIGS. 13–16.

Figure 13:
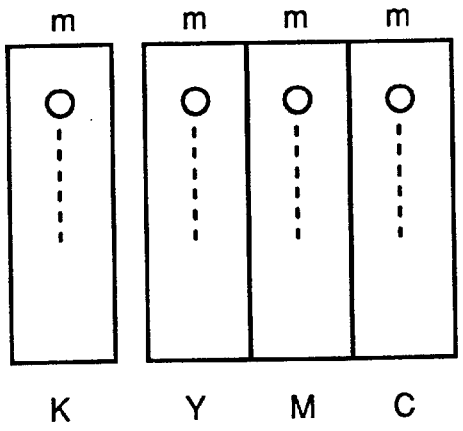
FIGS. 13–16 are plan views of a printer head for embodying the modifications.

Referring to FIG. 13, normal heads of a middle diameter (m) are aligned in the order of KYMC. Any head can have a printout of a dot of a large diameter by the output of a dot of the middle diameter two times in a slightly shifted manner.

Figure 14:
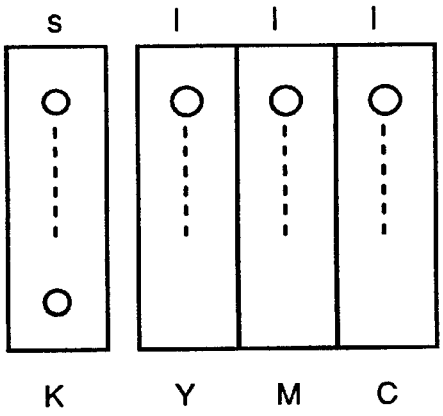

Referring to FIG. 14, a K head of a small diameter (s) and YMC heads of a large diameter (l) are aligned.

Figure 15:
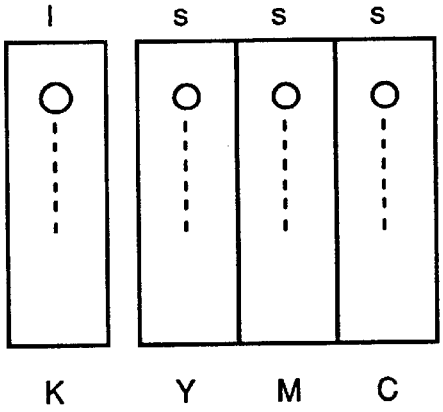

Referring to FIG. 15, a K head of a large diameter (l) and YMC heads of a small diameter (s) are aligned.

Figure 16:
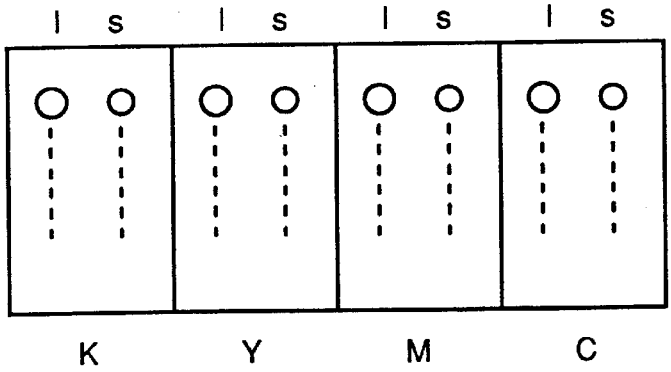

Referring to FIG. 16, a head of a large diameter and a head of a small diameter are provided in each of K, Y, M and C.

The present invention is not limited to a head that moves back and forth in the main scanning direction for printout. The present invention is applicable to a line type head having a row of nozzles formed over a range identical to the printable range in the main scanning direction that provides printout without the reciprocating movement.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image formation apparatus for forming an image on a recording medium, comprising:

a large printer head portion having at least one large diameter nozzle for ejecting ink droplets onto the recording medium to form a dot of a predetermined size and a predetermined color on the recording medium;

a small printer head portion having at least one small diameter nozzle for ejecting ink droplets onto the recording medium to form a dot, each of said at least one small diameter nozzle having a diameter which is smaller than a diameter of any of said at least one large diameter nozzle; and a controller for controlling said small printer head portion, in a first print mode, to eject an ink drop to print an ink dot having a size which is smaller than said dot of said predetermined size, said controller controlling said small printer head portion, in a second print mode, to eject a plurality of ink droplets to form an ink dot of a size substantially equal to said predetermined size and a color substantially equal to said predetermined color, wherein said controller is configured to control said small printer head portion in said second print mode when the image to be printed is a binary image.

2. An image formation apparatus according to claim 1, wherein said controller effects image formation by ejecting ink droplets from said at least one large diameter nozzle and from said at least one small diameter nozzle so that thus ejected ink droplets form dots on the recording medium to thereby form an image.

3. An image formation apparatus according to claim 1, wherein a shape of dots formed from ink droplets ejected by each of said at least one large diameter nozzle are substantially analogous to a shape of dots formed from ink droplets ejected by each of said at least one small diameter nozzle.

4. An image formation apparatus according to claim 1, wherein, in said second print mode, at least a portion of said plurality of ink droplets, as adhered to the recording medium, partially overlap.

5. An image formation apparatus according to claim 1, wherein said image formation apparatus is an ink jet apparatus that is capable of forming an image by ejecting ink droplets to form dots on the recording medium.

6. An image formation apparatus according to claim 1, wherein said large printer head portion has a plurality of large diameter nozzles and said small printer head portion has a plurality of small diameter nozzles.

7. An image formation apparatus according to claim 6, wherein said plurality of large diameter nozzles are oppositely positioned from said plurality of small diameter nozzles, forming an ink jet printer head capable of ejecting differently sized ink droplets.

8. An image formation apparatus according to claim 1, wherein said large printer head portion and said small printer head portion are adjacently positioned to form an ink jet printer head.

9. An image formation apparatus according to claim 8, wherein said large printer head portion and said small printer head portion are linearly aligned in a main scanning direction of said ink jet printer head.

10. An image formation apparatus according to claim 8, wherein said large printer head portion and said small printer head portion are linearly aligned along a secondary scanning direction of said ink jet printer head.

11. A printing control method for an image formation apparatus, said method comprising the steps of:

optionally ejecting ink droplets from a large diameter nozzle of a large diameter printer head portion onto a recording medium to form dots of a predetermined size and a predetermined color on the recording medium;

ejecting ink droplets from at least one small diameter nozzle of a small printer head portion onto the recording medium to form dots on the recording medium;

controlling said small printer head portion, in a first print mode, to eject an ink drop to print an ink dot having a size which is smaller than said dot of said predetermined size; and controlling said small printer head portion, in a second print mode, to eject a plurality of ink droplets to form an ink dot of a size substantially equal to said predetermined size and a color substantially equal to said predetermined color, wherein the step of controlling said small printer head portion in the second print mode is performed when an image to be printed is a binary image.

12. A printing control method according to claim 11, wherein said step of ejecting ink droplets from said small diameter nozzle comprises continuously ejecting a plurality of ink droplets.

13. A printing control method according to claim 12, wherein, in said second Print mode, said step of ejecting ink droplets from said small diameter nozzle comprises ejecting ink droplets so that at least a portion of said plurality of ink droplets, as adhered to the recording medium, partially overlap.

14. A printing control method according to claim 11, wherein an image is formed by both ejecting ink droplets from said large diameter nozzle and ejecting ink droplets from said small diameter nozzle.

15. A control device for an image formation apparatus including a large printer head portion having a large diameter nozzle for ejecting ink droplets to form large size dots of a predetermined color on a recording medium, and a small printer head portion having at least one small diameter nozzle for ejecting ink droplets to form dots on the recording medium, said control device comprising:

a controller for controlling said small printer head portion, in a first print mode, to eject an ink drop to print an ink dot having a size which is smaller than said large size dots, said controller controlling said small printer head portion, in a second print mode, to eject a plurality of ink droplets to form an ink dot of a size substantially equal to said large size dots and a color substantially equal to said predetermined color, wherein said controller is configured to control said small printer head portion in said second print mode when the image to be printed is a binary image.

16. A control device according to claim 15, wherein, in said second print mode, at least a portion of said plurality of ink droplets, as adhered to the recording medium, partially overlap.

17. A control device according to claim 15, wherein said control device is suitable for use in an ink jet apparatus that is capable of forming an image by ejecting ink droplets to form dots on the recording medium.

18. An image formation apparatus for forming an image on a recording medium, comprising:

a large printer head portion having a large diameter nozzle for ejecting ink droplets onto the recording medium to form a dot of a predetermined size;

a small printer head portion having a small diameter nozzle for ejecting ink droplets onto the recording medium to form a dot, said small diameter nozzle having a diameter which is smaller than a diameter of said large diameter nozzle; and a controller for controlling said small printer head portion, in a first print mode, to eject an ink drop from said small diameter nozzle to form a dot on said recording medium having a size which is smaller than said predetermined size, said controller controlling said small printer head portion, in a second print mode, to eject a plurality of ink droplets from said small diameter nozzle to form an ink dot on said recording medium having a size substantially equal to said predetermined size, wherein said controller is configured to control said small printer head portion in said second print mode when the image to be printed is a binary image.

19. An image formation apparatus in accordance with claim 18, wherein a shape of said dot formed from an ink droplet ejected by said large diameter nozzle is substantially analogous to a shape of said dot formed, in said second print mode, by said plurality of ink droplets ejected from said small diameter nozzle.

20. An image formation apparatus in accordance with claim 18, wherein said controller controls said small printer head portion to eject said plurality of ink droplets so that at least a portion of said plurality of ink droplets overlap others of said plurality of ink droplets on the recording medium.

21. An image formation apparatus in accordance with claim 18, wherein said large printer head portion includes a plurality of large diameter nozzles and said small printer head portion includes a plurality of small diameter nozzles.

22. A printing control method for an image formation apparatus, said method comprising the steps of:

optionally ejecting ink droplets from a large diameter nozzle of a large printer head portion onto a recording medium to form dots of a predetermined size;

ejecting ink droplets from a small diameter nozzle of a small printer head portion onto the recording medium to form dots;

controlling said small printer head portion, in a first print mode, to eject an ink drop from said small diameter nozzle to print an ink drop having a size which is smaller than said predetermined size; and controlling said small printer head portion, in a second print mode, to eject a plurality of ink drops from said small diameter nozzle to form an ink dot of a size which is substantially equal to said predetermined size, wherein the step of controlling said small printer head portion in the second print mode is performed when an image to be printed is a binary image.

23. A printing control method in accordance with claim 22, wherein said step of ejecting ink droplets from said small diameter nozzle comprises continuously ejecting a plurality of ink droplets.

24. A printing control method in accordance with claim 22, wherein said step of ejecting ink droplets from said small diameter nozzle comprises forming a plurality of dots with at least a portion of said plurality of dots partially overlapping others of said plurality of dots.

25. An image formation apparatus for forming an image on a recording medium, comprising:

a large printer head portion having a large diameter nozzle for ejecting ink droplets onto the recording medium to form a dot of a predetermined size;

a small printer head portion having a small diameter nozzle for ejecting ink droplets onto the recording medium to form a dot, said small diameter nozzle having a diameter which is smaller than a diameter of said large diameter nozzle; and a controller for controlling said small printer head portion, in a first print mode, to eject an ink drop from said small diameter nozzle to form a dot on said recording medium having a size which is smaller than said predetermined size, said controller controlling said small printer head portion, in a second print mode, to eject a plurality of ink droplets from said small diameter nozzle to form an ink dot on said recording medium having a size substantially equal to said predetermined size.

26. An image formation apparatus in accordance with claim 25, wherein a shape of said dot formed from an ink droplet ejected by said large diameter nozzle is substantially analogous to a shape of said dot formed, in said second print mode, by said plurality of ink droplets ejected from said small diameter nozzle.

27. An image formation apparatus in accordance with claim 25, wherein said controller controls said small printer head portion to eject said plurality of ink droplets so that at least a portion of said plurality of ink droplets overlap others of said plurality of ink droplets on the recording medium.

28. An image formation apparatus in accordance with claim 25, wherein said large printer head portion includes a plurality of large diameter nozzles and said small printer head portion includes a plurality of small diameter nozzles.

* * * * *

UNITED STATES PATENT AND TRADEMARK OFFICE

CERTIFICATE OF CORRECTION

PATENT NO. : 6,601,937 B2
DATED : August 5, 2003
INVENTOR(S) : Hideo Hotomi et al.

It is certified that error appears in the above-identified patent and that said Letters Patent is hereby corrected as shown below:

Column 10,
Line 15, after "size", delete ".", and insert -- , wherein the ink dot formed by the plurality of ink droplets ejected from said small diameter nozzle in the second mode is a substitution for an ink dot which would otherwise be formed by a single ink droplet ejected from said large diameter nozzle. --.

Signed and Sealed this

Twentieth Day of April, 2004

JON W. DUDAS
*Acting Director of the United States Patent and Trademark Office*